US008353581B2

(12) United States Patent
Shimizu

(10) Patent No.: US 8,353,581 B2
(45) Date of Patent: Jan. 15, 2013

(54) INKJET RECORDING APPARATUS

(75) Inventor: Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 763 days.

(21) Appl. No.: 12/027,427

(22) Filed: Feb. 7, 2008

(65) Prior Publication Data

US 2008/0192094 A1 Aug. 14, 2008

(30) Foreign Application Priority Data

Feb. 13, 2007 (JP) ..... 2007031586

(51) Int. Cl.
*B41J 2/175* (2006.01)

(52) U.S. Cl. ..... 347/85; 251/318

(58) Field of Classification Search ..... 347/22, 347/29–36, 85, 86, 92; 251/318
See application file for complete search history.

(56) References Cited

U.S. PATENT DOCUMENTS

| | | | | |
|---|---|---|---|---|
| 4,510,510 | A * | 4/1985 | Terasawa | 347/30 |
| 5,359,357 | A * | 10/1994 | Takagi et al. | 347/49 |
| 2003/0067517 | A1* | 4/2003 | Iri et al. | 347/85 |
| 2003/0146958 | A1* | 8/2003 | Aruga et al. | 347/85 |
| 2005/0088494 | A1* | 4/2005 | Shimizu et al. | 347/85 |
| 2005/0168519 | A1* | 8/2005 | Umeda | 347/29 |
| 2005/0195240 | A1* | 9/2005 | Hiraki | 347/33 |
| 2005/0212873 | A1 | 9/2005 | Usui et al. | |
| 2005/0231563 | A1 | 10/2005 | Fujishiro et al. | |
| 2005/0253909 | A1* | 11/2005 | Usui | 347/92 |
| 2006/0001715 | A1* | 1/2006 | Umeda et al. | 347/86 |
| 2006/0214981 | A1* | 9/2006 | Fukasawa et al. | 347/29 |
| 2007/0097170 | A1* | 5/2007 | Sekiya et al. | 347/30 |
| 2008/0174645 | A1 | 7/2008 | Umeda et al. | |
| 2009/0079787 | A1* | 3/2009 | Umeda | 347/30 |

FOREIGN PATENT DOCUMENTS

| | | | |
|---|---|---|---|
| JP | 63054252 | A * | 3/1988 |
| JP | H11-320901 | A | 11/1999 |
| JP | 2000-301732 | A | 10/2000 |

(Continued)

OTHER PUBLICATIONS

Japan Patent Office, Notification of Reason for Refusal for Japanese Patent Application No. 2007-031586 (counterpart to above-captioned patent application), dispatched May 24, 2011.

(Continued)

*Primary Examiner* — Charlie Peng
*Assistant Examiner* — Peter Radkowski
(74) *Attorney, Agent, or Firm* — Baker Botts L.L.P.

(57) ABSTRACT

An inkjet recording apparatus comprising: an ink tank that has an ink reservoir; a recording head that has an ink inlet connected to the ink reservoir; a box-shaped head holder on which the ink tank and the recording head are mounted; a discharge passage for discharging air separated from the ink, the discharge passage being opened through a valve element to the outside; and a manipulation member that is provided outside the head holder, wherein the head holder has a bottom wall portion and a side wall portion, wherein the recording head is fixed to the bottom wall portion, wherein the ink tank is fixed to the bottom wall portion, and wherein the inkjet recording apparatus further comprises a discharge case that has at least a part of the discharge passage therein and that is formed integrally with the head holder to constitute a part of the side wall portion.

5 Claims, 6 Drawing Sheets

FOREIGN PATENT DOCUMENTS

| | | | | |
|---|---|---|---|---|
| JP | 2003-001849 | A | | 1/2003 |
| JP | 2003001849 | A | * | 1/2003 |
| JP | 2004255862 | A | | 9/2004 |
| JP | 2005271552 | A | * | 10/2005 |
| JP | 2005-343123 | A | | 12/2005 |
| JP | 2005343123 | A | * | 12/2005 |

OTHER PUBLICATIONS

Japan Patent Office, Decision of Patent Grant for Japanese Patent Application No. 2007-031586 (counterpart to above-captioned patent application), dispatched Oct. 18, 2011.

* cited by examiner

INKJET RECORDING APPARATUS

CROSS REFERENCE TO RELATED APPLICATION

The present application claims priority from Japanese Patent Application No. 2007-031586, which was filed on Feb. 13, 2007, the disclosure of which is herein incorporated by reference in its entirety.

TECHNICAL FIELD

The present invention relates to an inkjet recording apparatus.

BACKGROUND

There has been known an inkjet recording apparatus in which an ink tank having an ink reservoir is built in a box-shaped head holder for holding a recording head (e.g., see Patent Document 1 for reference). The ink reservoir is connected to an ink inlet of the recording head. A discharge passage for discharging air, separated from ink reserved in the ink reservoir, to the outside is open to the outside through an openable/closable valve element.

In such an inkjet recording apparatus, generally, a recovery mechanism for absorbing ink from a nozzle of the recording head and a manipulation member for opening and closing the valve element are disposed adjacent to each other in a waiting position where the recording head is not opposed to a recording medium. In a state where the recording head is opposed to the recovery mechanism, the valve element is opened and closed by the manipulation member. Therefore, it is necessary that the recording head and the valve element are disposed with high precision.

[Patent Document 1] Japanese Unexamined Patent Application Publication No. 2005-271552 (FIG. 3)

SUMMARY

In Patent Document 1, a discharge case having the discharge passage and the valve element therein is formed integrally with the ink tank, and they are attached to the head holder for holding the recording head. For this reason, an attachment position of the head holder is determined according to a plurality of components such as the recording head and the head holder to which the ink tank is attached. Therefore, non-uniformity in tolerance of components is added, and thus it is difficult that the discharge case is positioned relative to the recording head with high precision.

An object of the invention is to provide an inkjet recording apparatus in which a discharge case is integrally formed with a head holder, so that the recording head and the discharge case can be disposed with high precision.

According to the first aspect of the invention, an inkjet recording apparatus comprising: an ink tank that has an ink reservoir; a recording head that has an ink inlet connected to the ink reservoir; a box-shaped head holder on which the ink tank is mounted, the head holder holding the recording head; a discharge passage for discharging ink reserved in the ink reservoir or air separated from the ink, the discharge passage being opened through an openable and closable valve element to the outside; and a manipulation member that is provided outside the head holder and allows the valve element to be opened and closed, wherein the head holder has a bottom wall portion and a side wall portion that is erected around the bottom wall portion, wherein the recording head is fixed to the bottom wall portion, wherein the ink tank is fixed to the bottom wall portion or the recording head fixed to the bottom wall portion, and wherein the inkjet recording apparatus further comprises a discharge case that has at least a part of the discharge passage therein and that is formed integrally with the head holder to constitute a part of the side wall portion.

With such a configuration, since the discharge case having at least a part of the discharge passage therein is formed integrally with the head holder to constitute a part of the side wall portion of the head holder, the positional relation between the recording head and the discharge case depends on a degree of fixing precision of the recording head with respect to the head holder. Accordingly, with a simple configuration, the recording head and the discharge case are disposed with high precision. Therefore, the positional relation between the manipulation member and the valve element can be formed with high precision.

As described above, since the discharge case having at least a part of the discharge passage therein is formed integrally with the head holder to constitute a part of the side wall portion, the recording head and the discharge case can be disposed with high precision. Therefore, the valve element can be securely manipulated by the manipulation member.

BRIEF DESCRIPTION OF THE DRAWINGS

Illustrative aspects of the invention will be described in detail with reference to the following figures wherein.

DETAILED DESCRIPTION OF THE PREFERRED EMBODIMENTS

Hereinafter, an exemplary embodiment of the invention will be described with reference to the drawings.

Figure 1:
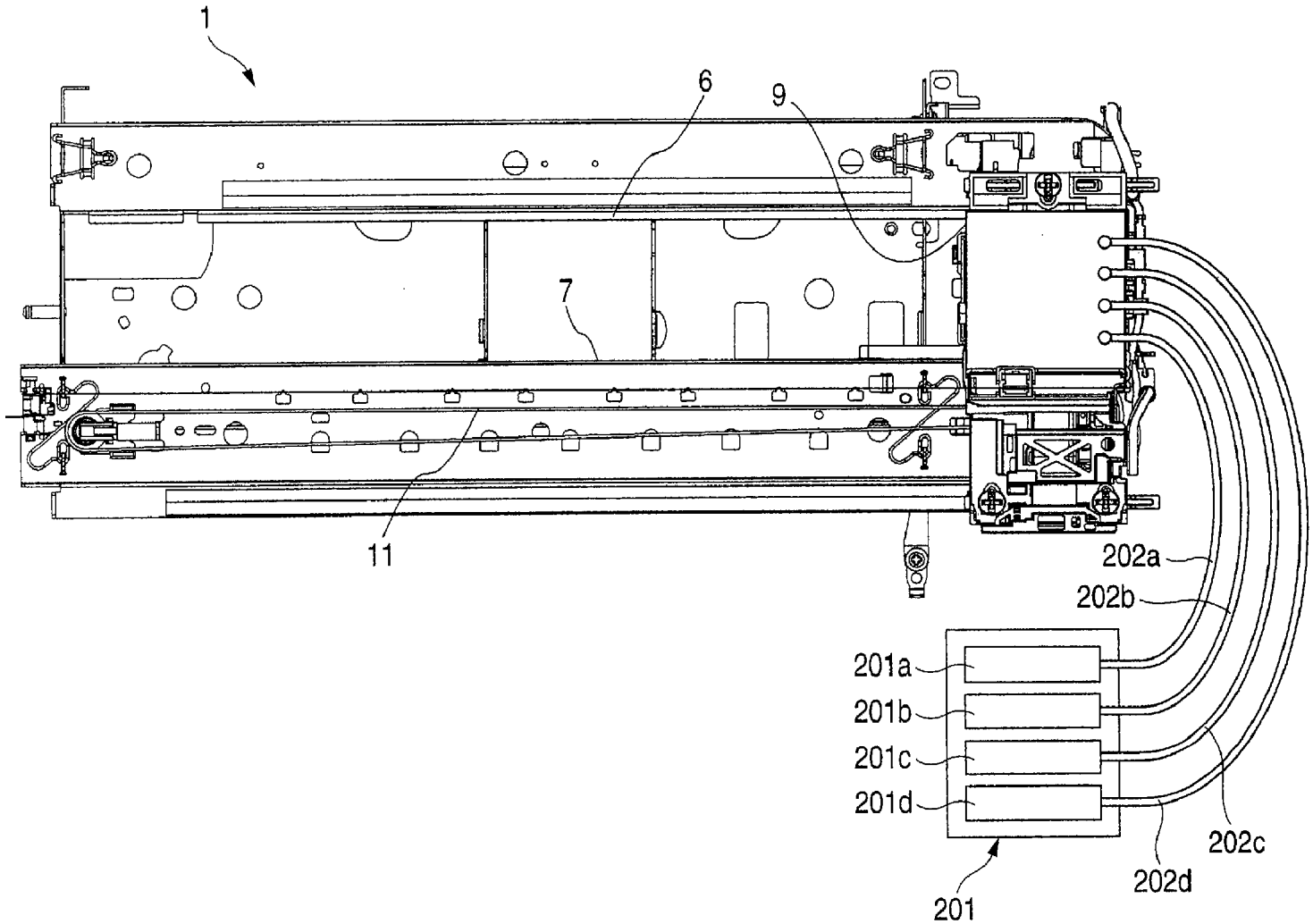
FIG. 1 is a plain view illustrating main configurations of an inkjet recording apparatus according to the invention.

FIG. 1 is a plain view illustrating main configurations of an inkjet recording apparatus according to the invention.

Figure 2:
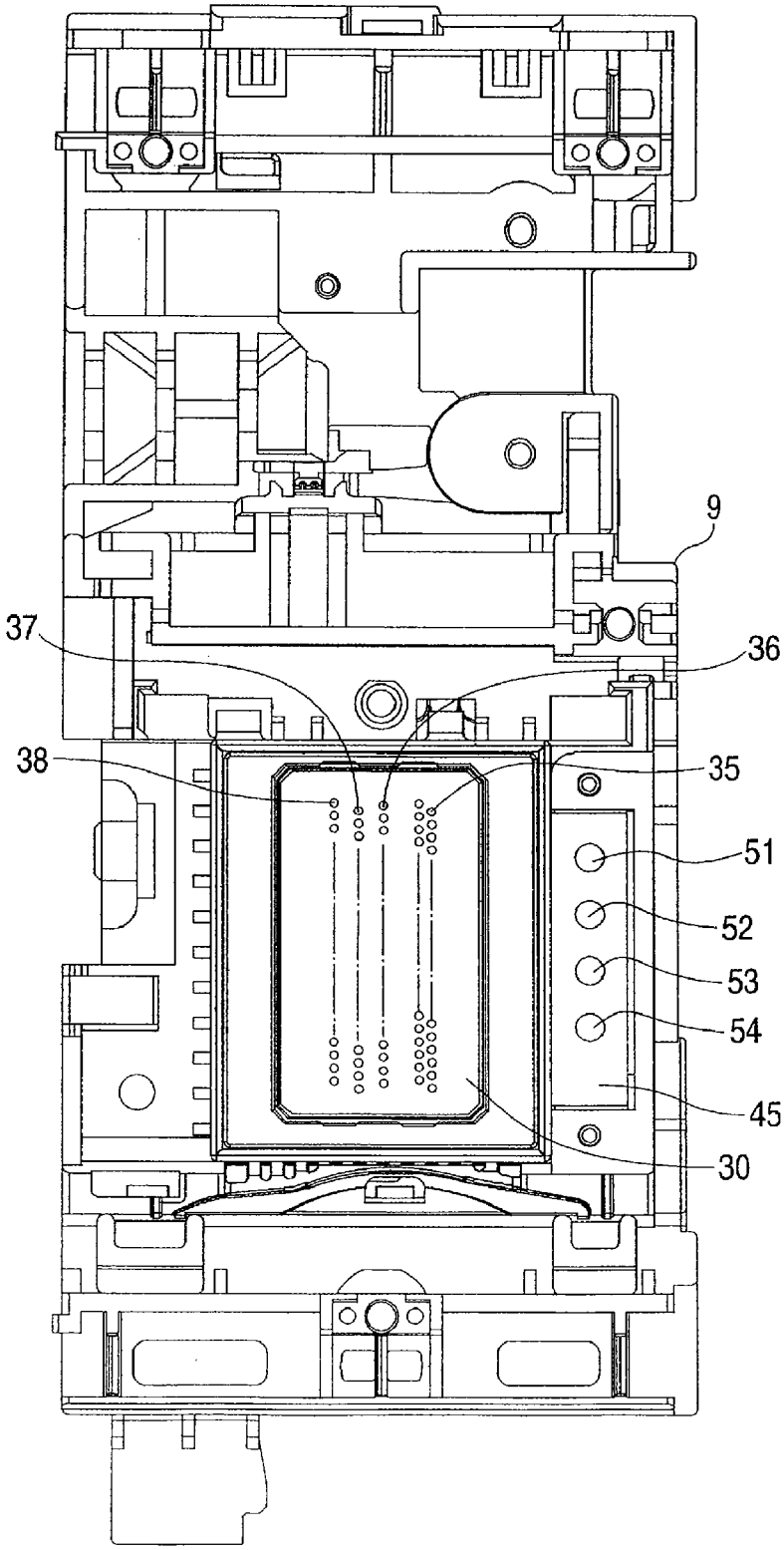
FIG. 2 is a bottom view illustrating a head holder on which an ink tank is mounted.
Figure 3:
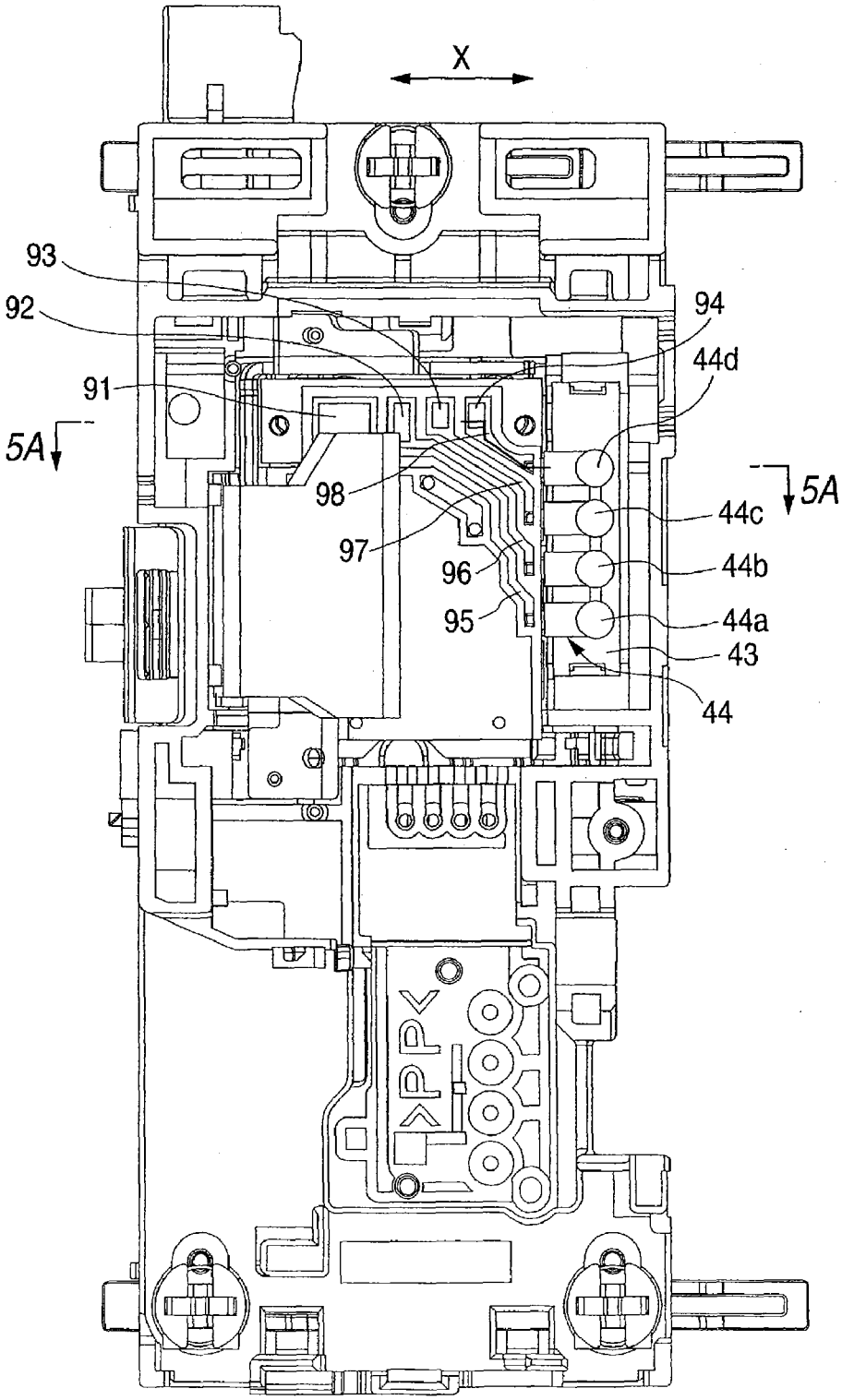
FIG. 3 is a plan view illustrating the head holder on which the ink tank is mounted.

As shown in FIG. 1, an inkjet recording apparatus 1 has two guide shafts 6 and 7 therein in parallel front and rear, and a head holder 9 used also as a carriage is attached to the guide shafts 6 and 7. The head holder 9 holds a recording head 30 that performs a recording process by ejecting ink to a recording medium. An ink tank 40 having a plurality of ink reservoirs 91 to 94 is mounted on the head holder 9, and ink is supplied from each ink reservoir to the recording head 30. The head holder 9, which is connected to an endless belt 11, is movable along a recording medium on the guide shafts 6 and 7 by rotating the endless belt 11. While the recording head 30 runs on the recording medium, ink is ejected from nozzles 35 to 38 (see FIG. 2 for reference) of the recording head 30. Each ink based on types is supplied from ink supply source provided outside the head holder 9 and storing ink based on types. That is, each ink based on types is supplied from a plurality of ink cartridges 201 (201*a* to 201*d*), through each flexible ink supply tube 202 (202*a* to 202*d*) to each ink reservoir.

Figure 5A:
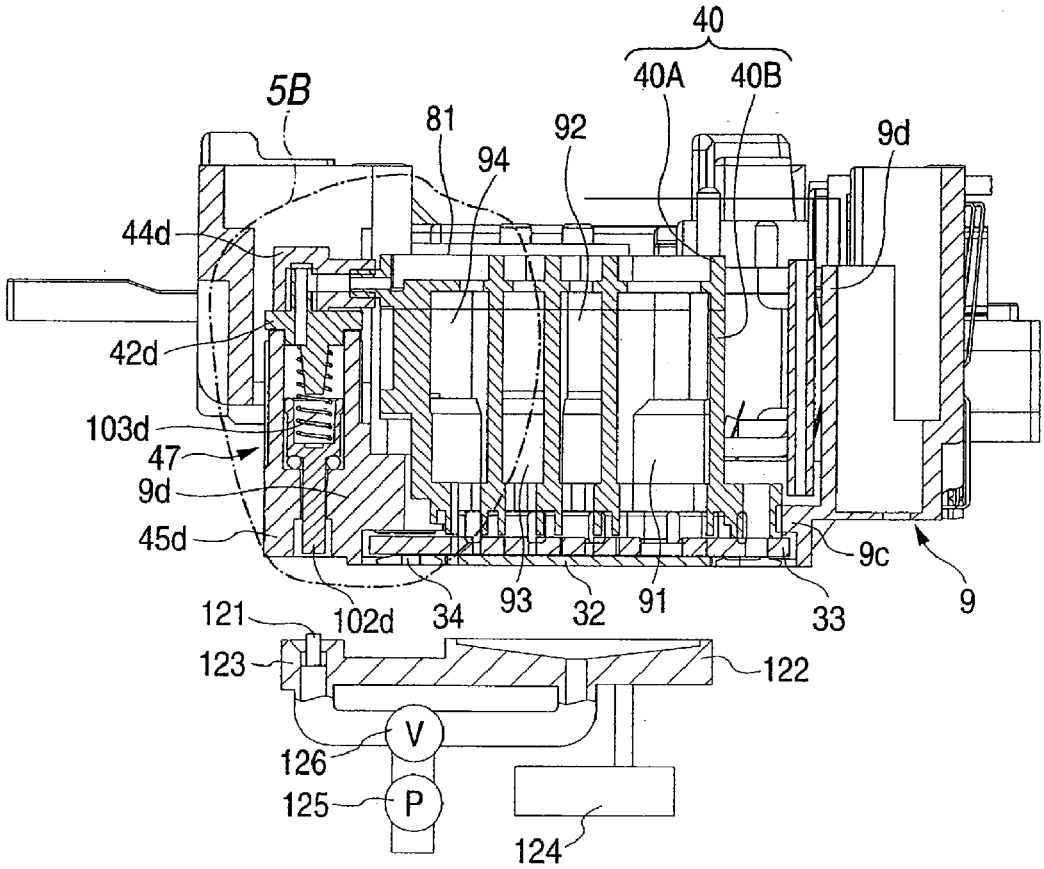
FIG. 5A is a sectional view taken along Line 5A-5A shown in FIG. 3.

The ink tank 40 includes an upper tank portion 40A and a lower tank portion 40B coupled with each other. As shown in FIG. 5, ink reservoirs 91, 92, 93, and 94 for yellow ink, magenta ink, cyan ink, and black ink are formed throughout both tank portions 40A and 40B. Upper spaces of the ink reservoirs 91 to 94 serve as accumulation portions in which air included in the ink are separated and temporarily accumulated. Upper ends of the ink reservoirs 91 to 94 are connected to upstream ends of discharge passages 95 to 98 formed as a concave groove for each ink reservoir, on the upper surface of the upper tank portion 40A. Downstream ends of the discharge passages 95 to 98 are connected to upper ends of discharge passages 51 to 54 in cases 45*a*, 45*b*, 45*c*, and 45*d* of a discharge valve unit 47 provided for each discharge passage. Each of the discharge passages 95 to 98 is defined by covering an open upper surface thereof with a flexible film 81 (FIG. 5A for reference).

Figure 4:
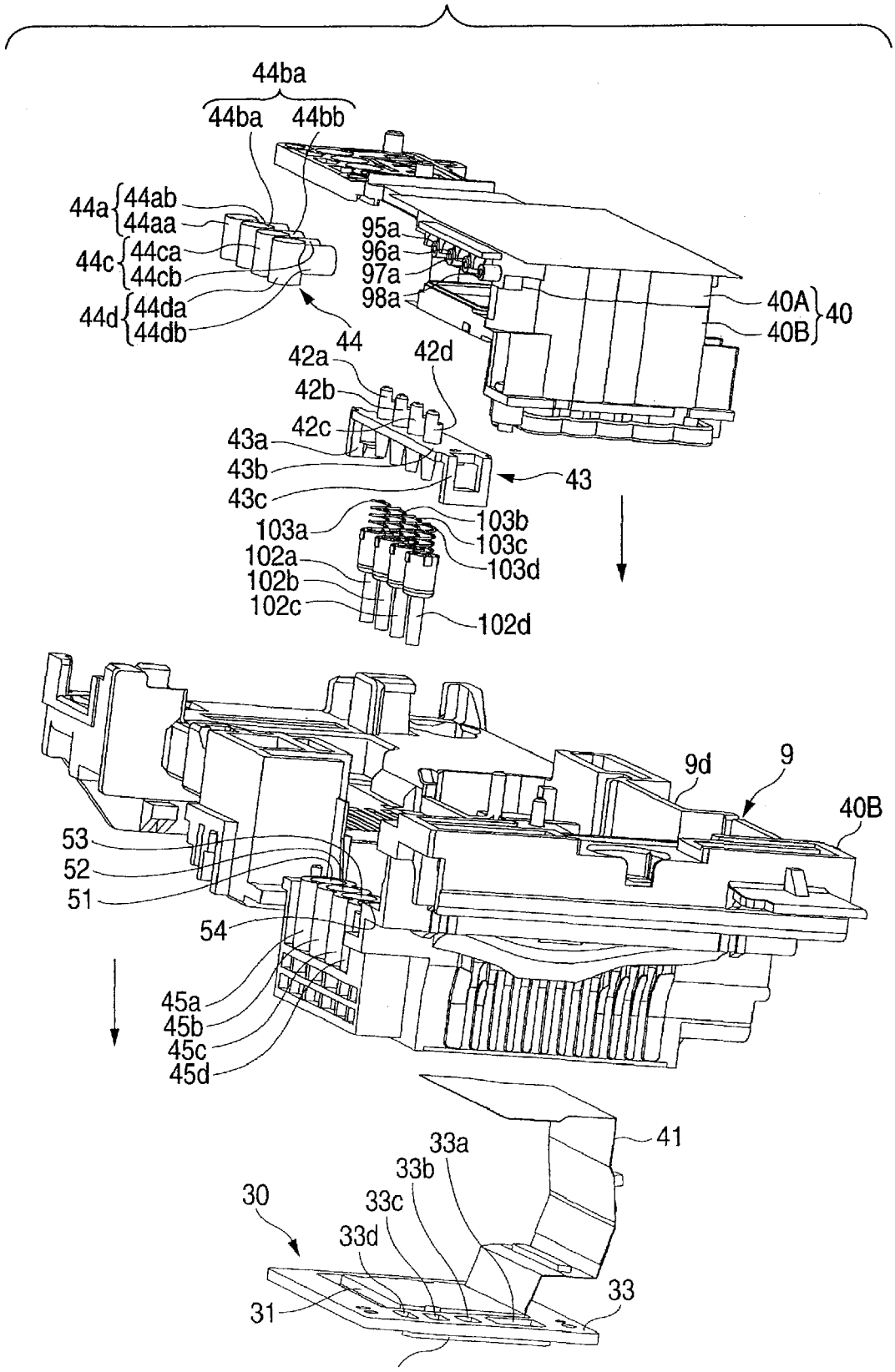
FIG. 4 is an exploded perspective view illustrating relation between the ink tank and the head holder.

As shown in FIGS. 4 and 5, the head holder 9 is formed in a box shape having a bottom wall portion 9*c* and a side wall portion 9*d* erected around the bottom wall portion 9*c*, and an upper portion of the head holder 9 is opened. The recording head 30 is fixed in a state where the recording head 30 is exposed downward to a lower surface of the bottom wall portion 9*c*. The recording head 30 has a cavity unit 32 having a plurality of rows of nozzles 35, 36, 37, and 38 on the lower surface of the recording head 30. A piezo actuator 31 that selectively applies ejection pressure to ink in the nozzles is laminated on the upside of the recording head 30. A base portion of a flexible flat cable 41 for applying a driving voltage to the piezo actuator 31 is fixed on the upper surface of the piezo actuator 31.

The recording head 30 is fixed by adhesive (not shown) introduced between the recording head 30 and the lower surface of the bottom wall portion 9*c* of the head holder 9, with a rectangular reinforcement frame 33 interposed there between on the upper surface of the recording head 30. Lower ends of the ink reservoirs 91 to 94 of the ink tank 40 are connected to ink inlets opened to the upper surface of the cavity unit 32 through ink passage holes 33*a* to 33*d* provided in the reinforcement frame 33. Ink is supplied from each ink reservoir of the ink tank 40 to each row of the nozzles 35 to 38. In order to protect the recording head 30 by getting rid of level difference on the lower side between the recording head 30 and the reinforcement frame 33, a protective cover 34 located around the recording head 30 is attached to the lower side of the reinforcement frame 33.

The ink tank 40 is housed on the bottom wall portion 9*c* in the head holder 9 and is fixed to the head holder 9. The ink tank 40 may be fixed to the recording head 30 fixed to the head holder 9, instead of the head holder 9.

The discharge valve unit 47 includes the cylindrical discharge cases 45*a* to 45*d* having the discharge passages 51 to 54 therein, and a valve element 102 housed therein. As shown in FIGS. 4 and 5, the cases 45*a* to 45*d* are arranged in a direction perpendicular to a scanning direction X of the recording head 30, the cases 45*a* to 45*d* have a shape continuing to each other, and extend in up and down directions along the side wall portion 9*d* of the head holder 9. The side wall portion 9*d* is parallel to an opening and closing manipulation direction of a protruding shaft portion 121 serving as a manipulation member that allows the discharge valve unit 47 to be opened and closed. The cases 45*a* and 45*d* are formed integrally with the head holder 9 to constitute a part of the side wall portion 9*d*. In the cases 45*a* to 45*d*, an upper end thereof opens, and a lower end thereof is located in the vicinity of the side of the recording head 30 held in the head holder 9 and opens. As described above, since the discharge valve unit 47 is formed as a part of the side wall portion 9*d* integrally with the head holder 9, positional relation between the recording head 30 held in the head holder 9 and the discharge valve unit 47 depends on a degree of fixing precision of the recording head 30 with respect to the head holder. Accordingly, the recording head 30 and the discharge valve unit 47 (cases 45*a* to 45*d*) are disposed with high precision.

The upper openings of the cases 45*a* to 45*d* are connected to introduction members 42*a*, 42*b*, 42*c*, and 42*d*, respectively. The introduction members 42*a* to 42*d* have through-holes communicating with the discharge passages 51 to 54 in up and down directions, respectively, and the introduction members 42*a* to 42*d* are formed integrally with a support member 43. The support member 43 includes a support portion 43*a* that supports a substantially middle position of the introduction members 42*a* to 42*d* in a longitudinal direction, and attachment portions 43*b* and 43*c* that are connected to both ends of the support portion 43*a* and attached to the side wall portion 9*d* by retainers. The support member 43 is attached to the side wall portion 9*d*, thereby holding valve elements and coil springs in the discharge passages 51 to 54 provided in the cases 45*a* to 45*d* and communicating with the through-holes of the introduction members 42*a* to 42*d*. Downstream end portions of the discharge passages 95 to 98 provided close to the ink tank 40 serve as cylindrical connection portions 95*a* to 98*a* toward a substantially horizontal direction. The connection portions 95*a* to 98*a* are connected to the upper end portions of the introduction members 42*a* to 42*d* through flexible connection ports 44*a*, 44*b*, 44*c*, and 44*d*, respectively. The connection ports 44*a* to 44*d* have cylindrical vertical portions 44*aa* to 44*da* having lower ends thereof inserted to the upper ends of the introduction members 42*a* to 42*d*, and have cylindrical horizontal portions 44*ab* to 44*db* having one ends communicating with the upper ends of the vertical portions 44*aa* to 44*da* and the other ends connected to the connection portions 95*a* to 98*a*. The connection portions 44*a* to 44*d* are integrated into the connection member 44.

Accordingly, the discharge passages 51 to 54 formed in the cases 45*a* to 45*d* communicate with the upper spaces of the ink reservoir through the introduction members 42*a* to 42*d*, the connection ports of the connection member 44, and the discharge passages 95 to 98 close to the ink tank 40.

Generally, the discharge valve unit 47 is closed to the outside of the discharge passages 51 to 54 in the cases 45*a* to 45*d*. The discharge valve unit 47 may be controlled to appropriately open, thereby discharging the ink reserved in the ink reservoirs 91 to 94 or the air accumulated in the upper space thereof, through the discharge passages 95 to 98 and the discharge passages 51 to 54 formed in the cases 45*a* to 45*d*.

Figure 5B:
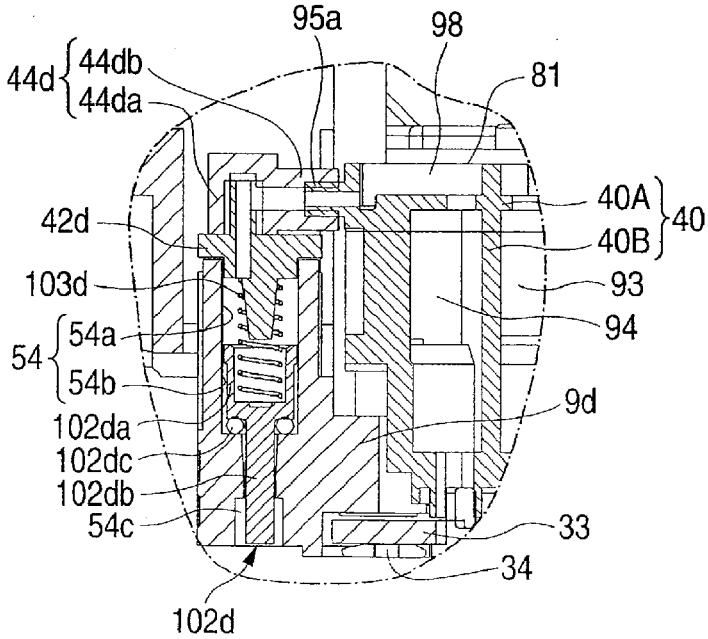
FIG. 5B is an enlarged view illustrating a portion 5B shown in FIG. 5A.

Since the discharge passages 51 to 54 have the same configuration, the inner configuration of the discharge valve unit 47 for yellow ink will be described hereinafter with reference to FIGS. 5A and 5B.

The discharge passage 54 formed in the case 45*d* extends and opens in up and down directions. An upper end thereof communicates with the discharge passage 98 and a lower end opens as a discharge hole 54*c* to the outside. The discharge passage 54 serves as a valve chamber in which a valve element 102*d* is slidable. The discharge passage 54 has a large-diameter hole portion 54*a* located at the upper portion thereof and a small-diameter hole portion 54*b* located at the lower portion thereof. The discharge hole 54*c* communicating with the small-diameter hole portion 54*b* in the lower portion thereof and serving as a portion opening to the outside also has the same axis shape as them.

The valve element 102*d* includes a large-diameter valve portion 102*da*, a small-diameter valve rod 102*db* integrally connected to the lower end thereof, and a ring-shaped sealing member 102*dc* fitted to the valve rod 102*db* at a position connected to the valve portion 102*da*. The large-diameter valve portion 102*da* is inserted to the large-diameter hole portion 54*a* of the discharge passage 54, and the valve rod 102*db* is inserted to the small-diameter hole portion 54*b*, with a space allowing ink or air to flow. Since the valve rod 102*da* is pushed up by the protruding shaft portion 121 of a maintenance unit 120 at the valve-opening time, the lower end thereof (in a state where the valve is closed) is located in the vicinity of the discharge hole 54*c*.

In addition, the valve element 102*d* is urged by a coil spring 103*d* provided between the lower portion of the introduction member 42*d* and the valve element 102*d*, in a direction in which the valve portion 102*da* comes into contact with the a stepwise valve sheet surface between a large-diameter portion 52*a* and a small-diameter portion 52*b* through the sealing member 102*dc*. At the normal time when the pushing-up force of the protruding shaft portion 121 does not act on the valve element 102*d*, the discharge valve unit 47 is in a valve-closing state where the discharge passage 54 does not communicate with the outside.

A maintenance unit 120 that performs a recovery process of the recording head 30 and a process of removing ink or air in the ink tank 40 will be described hereinafter. The maintenance unit 120 includes a first cap member 122 (recovery mechanism) openably covering the opening surface of the nozzles 35 to 38 of the recording head 30, and a second cap member 123 openably covering the lower surface (i.e., discharge holes 51*c* to 54*c*) of the discharge cases 45*a* to 45*d*, which are adjacent to each other. The maintenance unit 120 is provided outside the head holder 9 in a main body of the inkjet recording apparatus, at a position where the recording medium and the recording head 30 are not opposed to each other.

The first cap member 122 is opposed to the recording head 30 and receives ink discharged from the nozzles 35 to 38 of the recording head 30. The second cap member 123 surrounds the protruding shaft portion 121 serving as the manipulation member that allows the discharge valve unit 47 to be opened and closed, and the second cap member 123 receives ink or air discharged from the discharged holes 51*c* to 54*c* of the cases 45*a* to 45*d*.

As described above, the discharge case 45 is formed integrally with the head holder 9 as a part of the side wall portion 9*d*. Accordingly, the recording head 30 held in the head holder 9 and the valve discharge valve unit 47 are disposed with high precision. Therefore, positional relation among the first and second cap members 121 and 122, the recording head 30, and the discharge valve unit 47 can be formed with high precision. In addition, the positional relation between the protruding shaft portion 121 formed in the second cap member 123 and the small-diameter hole portion 54*b* of the discharge passage 54 can be formed with high precision.

Both cap members 122 and 123 are supported so as to move up and down by the same up/down moving mechanism 124 as the known maintenance unit. When the recording head 30 move to a waiting position where the recording head 30 is not opposed to the recording medium, the cap members 122 and 123 moves to a rising position to come into close contact with the nozzle opening surface of the recording head 30 and the lower surfaces of the cases 45*a* to 45*d* of the discharge valve unit 47, respectively. At the other position, the cap members 122 and 123 moves to a falling position to be separated from those A surfaces. The first cap member 122 or the second cap member 123 is selectively connected to a suction pump 125 by a switching valve 126.

The second cap member 123 has the protruding shaft portion 121 protruding from the cap member 123, at positions opposed to the discharge holes 51*c* and 54*c*. When the second cap member 123 comes into close contact with the lower surfaces of the cases 45*a* to 45*d*, the protruding shaft portion 121 pushes up the valve elements 102*a* to 102*d* against the urging force of the coil springs 103*a* to 103*d*, and the valve portion 102*da* is made in a valve-opening state where the valve portion 102*da* together with the sealing member 102*dc* becomes separated from the valve sheet surface.

At the normal time of performing a printing process, the discharge valve unit 47 is in the valve-closing state as described above, ink for ink colors is supplied from ink reservoir portions 12 to 15 to the nozzle rows of the recording head 30, and then the ink is ejected from the nozzle rows to the recording medium. Alternatively, when the recording head 30 move to the waiting position, the second cap member 123 comes into close contact with the lower surface of the discharge case 45. Accordingly, the valve rod 102*db* is pushed up by the protruding shaft portion 121 (manipulation member), thereby being in the valve-opening state. In this state, the second cap member 123 and the suction pump 125 are connected by the switching valve 126, and the suction pump 125 is driven, thereby collectively sucking the air accumulated in the upper space of the ink reservoirs 91 to 94 or the thickened ink and discharging the air or the ink to the outside. Then, the switching valve 126 is switched to connect the first cap member 122 to the suction pump 125, and the suction pump 125 is driven, thereby sucking the ink in the nozzles 35 to 38 of the recording head 30 and discharging the ink.

In addition to the aforementioned exemplary embodiment, the invention may be configured as follows.

(i) In the embodiment, by the second cap member 123 and the suction pump 125, the air accumulated in the upper space of the ink reservoirs 91 to 94 may be totally discharged (in this case, small amount of ink is also discharged) or the ink thickened in the ink supply tube for supplying ink from the ink supply source to the ink tank or in the upper portion of the ink tank may be discharged.

Figure 6:
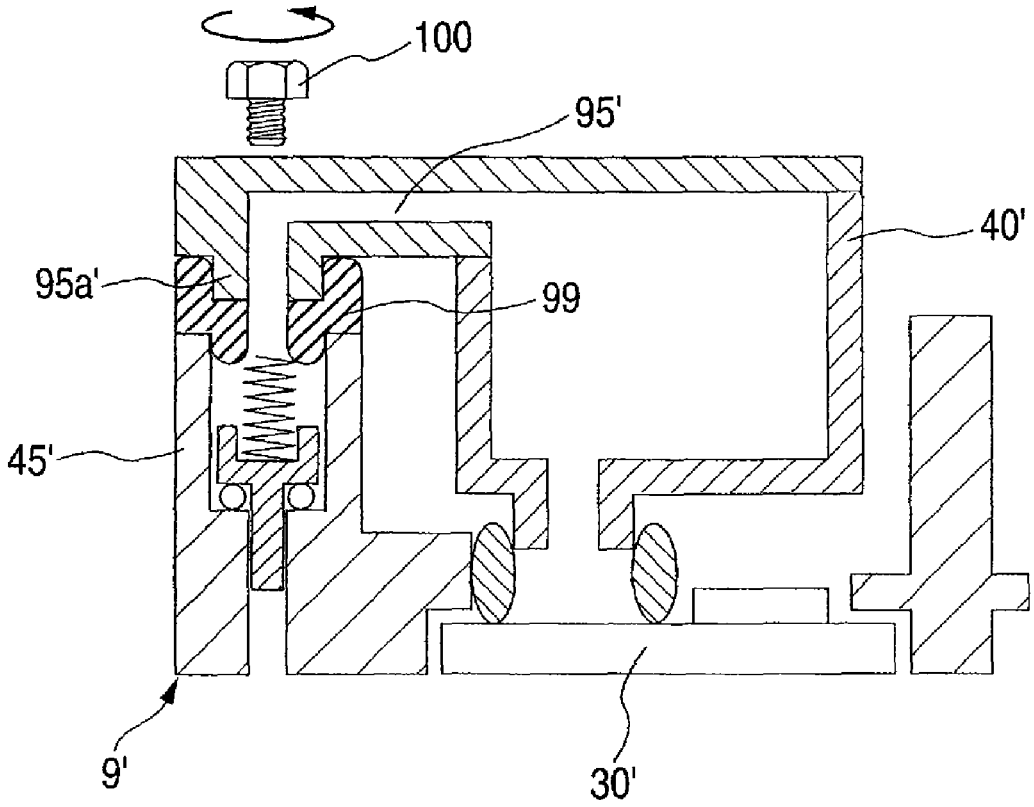
FIG. 6 is a view illustrating a modified example.

(ii) As shown FIG. 6, a discharge passage 95' may be formed from an upper portion of an ink tank 40' that supplies ink to a recording head 30' to an upper portion of a case 45' formed integrally with a head holder 9'. And, each cylindrical connection portion 95*a*' protruding downward may be provided at the upper portion of the case 45' in the discharge passage 95 for each ink. And the connection portion 95*a*' may be connected to an upper opening of the case 45' through a rubber packing 99. The ink tank 40' is fixed to the head holder 9' by a screw 100, thereby compressing the rubber packing 99 and securing a sealing property of the connected part.

(iii) In the maintenance unit 120, a sucking process in which the ink is sucked from the nozzles 35 to 38 of the recording head 30 and a discharging process in which the ink and the air are discharged through the discharge case, may be continuously executed. In addition, the first and second caps 122 and 123 may be ascended and descended by each up/down moving mechanism, respectively, so that the ink is only sucked from the nozzles 35 to 38, or the air or the ink may be only discharged through the discharge case, independently.

(iv) Instead of the suction operation of the suction pump 125, a positive pressure is applied from the ink supply source such as the ink cartridge to the ink to pressurize the inside of the ink reservoir, thereby discharging the thickened ink or foreign substances from the nozzles 35 to 38 of the recording head 30 or discharging the ink or the air through the discharge case. Alternatively, the suction operation and the positive pressure application to the ink may be commonly used.

As described above, according to the exemplary embodiment of the inkjet recording apparatus, a part of the side wall portion constituting the discharge case (45) may extend parallel to the opening and closing manipulation directions, an upper end of the discharge case (45) may be opened, the opening portion may be connected to an introduction member (42) communicating with an upper portion of the ink reservoir, and the valve element (102) may be held by the introduction member (42) in the discharge case (45).

With such a configuration, it is possible to discharge ink or air separated from the ink and existing in the ink reservoir, through the introduction member (42) communicating with the upper portion of the ink reservoir. It is possible to hold the valve element (102) in the discharge case (45). In addition, since a part of the side wall portion constituting the discharge case (45) extends parallel to the opening and closing manipulation directions of the manipulation member (123), there is an advantage that a manipulating force to open and close the valve element (102) decreases.

According to the exemplary embodiment of the inkjet recording apparatus, the discharge passage may be formed from an upper portion of the ink tank (40) to the discharge case (45), and a downstream end of the discharge passage close to the ink tank (40) may be connected to the introduction member (42) through a flexible connection member (44) that connects a downstream end close to the ink tank (40).

With such a configuration, the downstream end of the discharge passage close to the ink tank (40) is sufficiently connected to the introduction member (42) through the flexible connection member (44).

According to the exemplary embodiment of the inkjet recording apparatus, the discharge case (45) may constitute a part of the sidewall and may be formed in a cylindrical shape, a lower end thereof may open downward, the valve element (102) may be movably housed in the discharge case (45), the valve element (102) may be opened and closed by the manipulation member (123) through the lower opening of the discharge case (45).

With such a configuration, since the discharge case (45) is formed in the cylindrical shape as a part of the side wall of the head holder (9), the recording head (30) and the discharge case (45) are disposed with high precision. Accordingly, the valve element (102) is opened and closed with high precision by the manipulation member (123) through the lower opening of the discharge case (45).

According to the exemplary embodiment of the inkjet recording apparatus, the head holder (9) may be movably provided along a recording medium, a lower end portion of the valve element (102) may be located in the vicinity of a side of the recording head (30), and a recovery mechanism (122) that is opposed to the recording head (30) and receives ink discharged from a nozzle of the recording head (30) may be disposed adjacent to the manipulation member (123), in the outside of a position where the recording head (30) and the recording medium are opposed to each other.

With such a configuration, since the lower end of the valve element (102) is located in the vicinity of the side of the recording head (30), the recovery mechanism (122) that is opposed to the recording head (30) and receives the ink discharged from the nozzles of the recording head (30) can be disposed adjacent to the manipulation member (123), thereby accomplishing a compact size.

According to the exemplary embodiment of the inkjet recording apparatus, the ink tank may (40) have a plurality of the ink reservoirs, the ink may be supplied from an ink supply source (201) for storing ink based on ink types to each ink reservoir based on ink types through an ink supply tube (202), the ink may be supplied from each ink reservoir to the recording head (30), the ink may be ejected while the plurality of ink reservoirs and the recording head (30) runs on the recording medium, and the discharge passage may be provided for each ink reservoir.

With such a configuration, the inkjet recording apparatus can supply many types of ink from the ink tank (40) through the ink supply tube (202) to the ink reservoir and the recording head (30).

What is claimed is:

1. An inkjet recording apparatus comprising:

an ink tank that has an ink reservoir;

a recording head that has an ink inlet connected to the ink reservoir;

a box-shaped head holder on which the ink tank is mounted, the head holder holding the recording head;

a discharge passage for discharging ink reserved in the ink reservoir or air separated from the ink, the discharge passage being opened through an openable and closable valve element to the outside; and a manipulation member that is provided outside the head holder and allows the valve element to be opened and closed, wherein the head holder has a bottom wall portion and a side wall portion that is erected around the bottom wall portion, wherein the recording head is fixed to the bottom wall portion, wherein the ink tank is fixed to the bottom wall portion or the recording head fixed to the bottom wall portion, wherein the head holder further comprises a discharge case that has at least a part of the discharge passage therein and that is formed integrally with the head holder to constitute a part of the side wall portion, wherein a part of the side wall portion constituting the discharge case extends parallel to the opening and closing manipulation directions and the discharge case has an opening portion formed on an upper end thereof, wherein the opening portion is connected to an introduction member communicating with an upper portion of the ink reservoir, wherein the valve element is held in the discharge case by the introduction member, wherein a second part of the discharge passage is formed from an upper portion of the ink tank to the discharge case, wherein the inkjet recording apparatus further comprises a flexible connection member that connects a downstream end of the second part of the discharge passage close to the ink tank to the introduction member such that the at least a part of the discharge passage formed in the discharge case communicates with the upper portion of the ink tank through the introduction member, the flexible connection member, and the second part of the discharge passage, and wherein the bottom wall portion is connected directly to the side wall portion.

2. The inkjet recording apparatus according to claim 1, wherein the discharge case is formed in a cylindrical shape and a lower end thereof opens downward, and wherein the valve element is movably housed in the discharge case and is opened and closed by the manipulation member through the lower opening of the discharge case.

3. The inkjet recording apparatus according to claim 1, wherein the head holder is movably provided along a recording medium, wherein a lower end portion of the valve element is located in the vicinity of a side of the recording head, and wherein the inkjet recording apparatus further comprises a recovery mechanism that is disposed adjacent to the manipulation member and that is opposed to the recording head to receive ink discharged from a nozzle of the recording head, in the outside of a position where the recording head and the recording medium are opposed to each other.

4. The inkjet recording apparatus according to claim 1, wherein the ink tank has a plurality of the ink reservoirs, the inkjet recording apparatus further comprising an ink supply source for storing ink based on ink types and an ink supply tube for supplying the ink from the ink supply source to each ink reservoir based on ink types, wherein the ink is supplied from each ink reservoir to the recording head, and the ink is ejected while the plurality of ink reservoirs and the recording head runs on the recording medium, and wherein the discharge passage is provided for each ink reservoir.

5. The inkjet recording apparatus according to claim 1, wherein the introduction member is a separate member from the discharge case and supports the valve element to be movable in the discharge case at a bottom side of the introduction member.

* * * * *